US010099229B2

(12) United States Patent
Greiner-Perth et al.

(10) Patent No.: US 10,099,229 B2
(45) Date of Patent: Oct. 16, 2018

(54) DISPENSER FOR DISPENSING LIQUIDS

(71) Applicants: Juergen Greiner-Perth, Gottmadingen (DE); Matthias Wochele, Rielasingen-Worblingen (DE)

(72) Inventors: Juergen Greiner-Perth, Gottmadingen (DE); Matthias Wochele, Rielasingen-Worblingen (DE)

(73) Assignee: APTAR RADOLFZELL GMBH, Radolfzell (DE)

( * ) Notice: Subject to any disclaimer, the term of this patent is extended or adjusted under 35 U.S.C. 154(b) by 48 days.

(21) Appl. No.: 15/259,938

(22) Filed: Sep. 8, 2016

(65) Prior Publication Data

US 2016/0375448 A1 Dec. 29, 2016

Related U.S. Application Data

(62) Division of application No. 14/180,452, filed on Feb. 14, 2014, now Pat. No. 9,463,476.

(30) Foreign Application Priority Data

Feb. 16, 2013 (DE) ..... 10 2013 202 531

(51) Int. Cl.
*B05B 11/00* (2006.01)
*B05B 1/18* (2006.01)
(Continued)

(52) U.S. Cl.
CPC ..... *B05B 1/185* (2013.01); *B05B 1/14* (2013.01); *B05B 1/18* (2013.01); *B05B 11/0064* (2013.01); *B05B 11/0067* (2013.01); *B65D 83/48* (2013.01)

(58) Field of Classification Search
CPC ... B05B 1/14; B05B 11/0064; B05B 11/0067; B05B 1/185; B05B 1/18; B05B 11/3002;
(Continued)

(56) References Cited

U.S. PATENT DOCUMENTS 2,017,467 A 10/1935 Loomis
4,884,750 A 12/1989 Werding
(Continued)

FOREIGN PATENT DOCUMENTS

DE 201 02 271 U1 6/2001
EP 0 516 498 A1 12/1992
(Continued)

*Primary Examiner* — Darren W Gorman
*Assistant Examiner* — Juan C Barrera
(74) *Attorney, Agent, or Firm* — Flynn Thiel, P.C.

(57) ABSTRACT

Dispenser with a liquid storage unit, a dispensing head with a perforated plate component which has at least 25 dispensing openings in a dispensing opening region, with a pre-chamber connected upstream of the dispensing openings of the perforated plate component and from which the dispensing openings are supplied, and a connecting channel which connects the liquid storage unit to the pre-chamber. The perforated plate component is fastened on the dispensing head in an edge region and the dispensing opening region is pressed into a curved form by means of a curvature body which is arranged in the pre-chamber and acts with force upon the perforated plate.

21 Claims, 9 Drawing Sheets

(51) Int. Cl.
*B05B 1/14* (2006.01)
*B65D 83/48* (2006.01)

(58) Field of Classification Search
CPC ..... B05B 11/3004; B05B 11/007; B05B 11/0072; B65D 83/48
USPC ..... 239/462, 498, 500, 504, 509, 520, 521, 239/333, 459, 583; 222/478, 190, 380, 222/491–497, 321.7, 321.8, 321.9, 335
See application file for complete search history.

(56) References Cited

U.S. PATENT DOCUMENTS 5,271,533 A 12/1993 Joulia
5,358,179 A * 10/1994 Lund ..... B05B 1/26 239/333
6,053,372 A 4/2000 Abedi
6,196,219 B1 3/2001 Hess et al.
6,338,442 B1 1/2002 De Laforcade
6,341,735 B1 1/2002 Baudin
6,695,171 B2 2/2004 Walters et al.
6,824,021 B2 * 11/2004 Masuzzo ..... B05B 11/0072 239/321.7
7,481,382 B2 1/2009 Christ
7,703,634 B2 4/2010 Roehrig
7,748,647 B2 7/2010 Clerget et al.
8,006,870 B2 8/2011 Stadelhofer et al.
8,827,124 B2 9/2014 Painchaud et al.
2006/0060591 A1 3/2006 Rohrig
2006/0213408 A1 9/2006 Christ
2007/0210114 A1 9/2007 Stadelhofer et al.
2007/0210115 A1 9/2007 Stadelhofer et al.
2007/0210121 A1 9/2007 Stadelhofer et al.
2008/0006719 A1 * 1/2008 Clerget ..... B05B 1/14 239/337
2009/0026289 A1 * 1/2009 Nadler ..... B05B 11/0016 239/333
2011/0057057 A1 * 3/2011 Songbe ..... B05B 1/3436 239/463
2011/0084100 A1 * 4/2011 Welp ..... B05B 1/3436 239/463
2012/0305599 A1 12/2012 Painchaud et al.
2013/0306683 A1 * 11/2013 Wochele ..... B05B 11/0054 222/383.1

FOREIGN PATENT DOCUMENTS

EP 0 923 957 A1 6/1999
EP 1 052 191 A1 11/2000
EP 1 520 797 A1 4/2005
EP 1 637 232 A1 3/2006
EP 1 698 399 A1 9/2006
EP 1 834 703 A2 9/2007
EP 1 878 507 A2 1/2008
FR 2 524 348 10/1983
WO WO 2004/065247 A1 8/2004
WO WO 2011/030063 A1 3/2011
WO WO 2012/074045 A1 6/2012

* cited by examiner

DISPENSER FOR DISPENSING LIQUIDS

CROSS-REFERENCE TO RELATED APPLICATIONS

This is a divisional of U.S. Ser. No. 14/180,452, filed Feb. 14, 2014, which claims priority from German Application No. 10 2013 202 531.9, filed on Feb. 16, 2013, the disclosures of which are hereby incorporated by reference in their entireties into this application.

FIELD AND BACKGROUND OF THE INVENTION

The invention relates to a dispenser for dispensing liquids, said dispenser having a liquid storage unit, a dispensing head with a perforated plate component which has at least 25 dispensing openings in a dispensing opening region, a pre-chamber which is connected upstream of the dispensing openings of the perforated plate component and from which the dispensing openings are supplied and a connecting channel which connects the liquid storage unit to the pre-chamber.

The use of perforated plates for dispensing liquids is known in particular from the area of such dispensers which have a vibration device by means of which liquid is pressurized in a pulsed manner in a dosing chamber and, as a result, is pressed through the dispensing openings. The result of such dispensing is a fine mist. A dispenser with such a perforated plate is known, for example, from EP 0 923 957 A1. Although the measures according to the invention which are proposed within the framework of this document are basically also usable in the case of such a realization of dispensers, the invention does relate in particular to dispensers which are not provided with electric actuators such as vibration devices, but instead obtain the liquid pressure to generate the dispensing either as a result of bringing in mechanical energy during the actuation or, however, from the pressurization of the liquid in the liquid storage unit which is already present at delivery.

SUMMARY OF THE INVENTION

It is the object of the invention, with regard to dispensers, in particular with regard to dispensers that are not electrically operated, to make it possible to influence the dispensing characteristics thereof in an advantageous manner, the intention being, in particular, to enable dispensers with different dispensing characteristics by way of a comparatively large number of matching components.

According to a first aspect of the invention, this is achieved in that in the case of a dispenser of the type mentioned in the introduction, the dispensing opening region is fastened on the dispensing head or a housing component in an edge region and is pressed into a curved form by means of a curvature body which is arranged in the pre-chamber and acts with force upon the dispensing opening region.

In the case of a dispenser according to the invention, there is provided a liquid storage unit in which the liquid is present before the dispensing. In this case, the liquid, which is preferably a cosmetic or pharmaceutical liquid, can be present unpressurized, in this case part of the dispenser being a pumping device which enables pressurization to generate the desired dispensing. As an alternative to this, liquid which is already pressurized and which can be output to the surrounding area by opening an outlet valve can also be present in the liquid storage unit. The liquid is output through a dispensing head which includes the named perforated plate component which, in turn, has the dispensing openings. In this case, this is in particular preferably a plastics material component which can consist, for example, of polypropylene (PP), polyethylene (PE), polyoxymethylene (POM), polybuteneterephthalate (PBT) or cycloolefin copolymer (COC). The at least 25 dispensing openings are provided in said component, which is preferably produced using the injection moulding method and which has in particular preferably a thickness of between 0.1 mm and 1.5 mm, in particular of between 0.2 mm and 0.8 mm. In particular, there can preferably be a higher number of dispensing openings, in particular preferably more than 50 dispensing openings. The perforated plate component is fastened on the edge of a housing of the dispensing head or can also be realized integrally with the same. The dispensing opening region of the perforated plate component is preferably flat in the non-mounted state of said component. In the installed state, in contrast, it is curved, this being achieved in that it is pressed into the curved form by means of a curvature body which is arranged in the pre-chamber or defines the pre-chamber.

It is consequently provided in the case of said realization according to the invention that the perforated plate component and in particular the dispensing opening region thereof is deformed in the mounted state in relation to the non-mounted state and that for this purpose force is applied from the pre-chamber.

The outward curvature allows for the creation of a diverging alignment of the dispensing jet which consists of individual jets. This is expedient for a plurality of applications, thus, for example, in order to be able to distribute the liquid over a large area, for example on the skin of a user. The diverging dispensing characteristics, however, can also be advantageous for special fields of application where a multitude of areas are to be acted upon with liquid in a targeted manner, such as, for example, in the event of a throat spray dispenser which is to be able to reach rear throat areas of the patient with liquid past on the left and right of the uvula of a patient.

The development of the dispenser according to the invention with a deformed dispensing opening region in the mounted state in relation to the non-mounted state also allows, in particular, proceeding from identically designed non-deformed perforated plate components, for adaptation to special fields of application to be undertaken from case to case by influencing, among other things, the degree of curvature.

This can be achieved, for example, by utilizing different curvature bodies. As an alternative to this, the relative arrangement of the curvature body and of the perforated plate component can also be developed variably in the mounted state. In the case of a realization which is particularly advantageous in this respect, it is provided that the perforated plate component and the curvature body are adapted to one another and, where applicable, to a housing of the dispensing head in such a manner that they allow for a variable relative position of assembly of this type. Thus, for example, the curvature body or the perforated plate component could be fastened in one of several discrete positions on the other component or on the housing of the dispensing head. A stepless possibility for the variable spacing can also be provided as an alternative to this, for example by the perforated plate component or the curvature body being realized so as to be fixed in a force-fitting manner on the other component or on the housing of the dispensing head.

Although it is advantageous for adapting the dispensing characteristics of a dispensing head according to the invention if the curvature body is provided as a separate component to a housing of the dispensing head, the invention also includes other developments where a housing, which forms, at least in portions, outside faces of the dispensing head, is at the same time integrally connected to the curvature body or the inside body.

The named adjustability can, but does not have to, be limited to the time of production, in particular of assembly. A realization where the possibility of the relative displacement of the perforated plate component, in particular of the edge region thereof, on the one hand, and of the curvature body, on the other hand, is possible for the user or patient, can also be conceivable and, depending on the purpose of the application, advantageous. Thus, for example, a curvature body which is displaceable by means of a thread could allow for the degree of curvature of the dispensing opening region to be adjusted from case to case.

Along with the possibility of a realization where the perforated plate component is realized in a planar manner in the dispensing opening region pointing towards the pre-chamber and is deformed as a result of a curvature body which, in turn, protrudes or is curved, there is principally also the possibility of providing even on the inside surface in the dispensing opening region an elevation which points in the direction of the curvature body and in the mounted state brings about the curvature of the dispensing opening region. Such a curvature spin can be realized in production in a simple manner with a variable length such that at little expense it is possible to produce perforated plate components which do not differ from one another up to the extension of the elevation/of the curvature spin.

According to a further aspect of the invention which is realized preferably together with the aspects of the invention already named, it is possible to provide in the inside of the dispensing opening region, that is in the region of the pre-chamber, a cover body which has at least one closing face, at least one of the dispensing openings being closable or closed as a result of the at least one closing face abutting against an inside surface of the dispensing opening region.

With regard to its particular function, said named body is called a cover body in this context. However, it can be identical to the already-described curvature body where the aforementioned features of the invention are realized.

The characteristic according to said aspect of the invention is that at least when no pressurized liquid is present in the pre-chamber, at least some of the dispensing openings are closed by the cover body.

In this case, said closing of at least one dispensing opening can be a permanent state. This means that the dispensing opening remains closed irrespective of the liquid pressure in the pre-chamber and consequently when the dispenser is used correctly the dispensing opening will never be traversed by liquid. Other dispensing openings, in contrast, are not closed by closed openings and consequently are provided for the actual dispensing of the liquid.

The permanent partial closing of dispensing openings allows identically designed perforated plate components to be used for different application purposes, adapted from case to case, where different spray patterns are provided. Thus, for example, a cover body could be realized in such a manner that it keeps the dispensing openings open in only two regions of the dispensing opening region that are spaced apart from one another, whilst it closes the other ones. Consequently, it could be possible to generate two separate jets or jet bundles which are dispensed in a diverging manner and consequently, for example, are really suitable for the above-mentioned purpose of a throat spray dispenser.

Above all, however, the permanent closing of dispensing openings allows the volume flow to be dispensed to be adapted case by case. Thus, with components of a dispenser or at least of the dispensing head that are unchanged for the rest, depending on the liquid used or the intended area of application, it is possible to generate different liquid flows.

Along with the possibility of closing dispensing openings permanently by means of the cover body by the cover body abutting against the inside surface of the perforated plate in the region of the dispensing opening in question irrespective of the liquid pressure during the dispensing operation, it is also possible to develop the cover body and to adapt it to the perforated plate component as well as the correct liquid pressures in such a manner that when the liquid is pressurized the closing face is separated from the dispensing opening such that the latter then allows liquid to pass in a correct manner. A type of valve action is achieved with such a realization. The cover body prevents the ingress of contaminants by way of its closing face when the dispenser is not utilized. As soon as the dispenser is used, the closing body is separated from the dispensing opening region under the liquid pressure and allows the liquid to be dispensed. The separation of the closing body from the dispensing opening region is preferably achieved as a result of the dispensing opening region being curved or displaced under the influence of the liquid pressure.

In the case of the aforementioned variants where the cover body closes the dispensing openings permanently, there are preferably provided on the cover body, on its side pointing towards the dispensing opening region, free regions such as grooves or indentations through which the liquid is able to pass to the dispensing openings which are not closed by the closing face. The cover body consequently serves not only for selectively closing dispensing openings, but also for forming channels which serve to supply the non-closed dispensing openings.

The inflow of liquid, in this case, can be effected from outside into a gap region between the dispensing opening region and the cover body/inside body. Depending on the development of the dispenser, however, it has also proved to be structurally expedient when the cover body itself is penetrated by an inflow channel which, for example, allows the direct supply of the liquid to be dispensed into a central region of the dispensing opening region.

Along with the described valve action which can be achieved, in particular, as a result of the deformability of the dispensing opening region, in the case of a further aspect of the invention it is provided that a generic dispenser has an outlet valve which has two valve components, of which one is a valve seat which is fixed in position with respect to an outside housing of the dispensing head and the other is a valve body which is movable in relation to said valve seat and controls the inflow of liquid to the dispensing opening together with the valve seat, wherein one of the valve components is formed by the perforated plate component.

According to said variant for forming an outlet valve, it is consequently provided that there are provided two valve components, which are movable towards one another as one unit, one of which is the perforated plate component. Said valve components are preferably pressed one against another by a spring means such as a helical spring, said components being matched to one another in such a manner that a spacing between the valve components in opposition to the force of said spring means can be achieved as a result of the liquid pressure. It can be provided that the liquid pressure necessary for the opening relative displacement is built up directly in the region in front of the dispensing openings. However, developments are also conceivable where a pressurization face is provided locally on the movable valve component in front of the dispensing openings such that liquid does not pass into a gap between the valve components in the region of the dispensing openings until the valve components are displaced towards one another.

In the case of a further aspect of the invention, it is provided that in the case of a generic dispenser there is provided in the pre-chamber an inflow control body which, at least in the region of a dispensing opening, together with the perforated plate body defines a gap, the inside width of which preferably does not exceed 0.3 mm and in particular preferably does not exceed 0.1 mm. In the case of such a development it is consequently provided that there is an extremely narrow gap between the inflow control body and the at least one dispensing opening, preferably all of the dispensing openings. The small width of less than 0.3 mm, in particular of preferably less than 0.1 mm, has proved to be advantageous as it allows the dispensing characteristics to be modified by varying the roughness of the surface of the inflow control body in a targeted manner.

The inside width can even be 0 mm when using an inflow control body with a rough surface such that the inflow control body abuts directly against the dispensing opening region. It is proposed to this end that the end face of the inflow control body is realized in such a case with a peak-to-valley height $R_t$ of between 10 μm and 100 μm. This allows an inflow of liquid to the dispensing openings without requiring a relative movement between the inflow control body and the dispensing opening region towards one another. The peak-to-valley height alone is sufficient to enable the inflow of liquid to the dispensing openings. It is also possible to adjust the volume flow in a precise manner as a result of the targeted choice of the peak-to-valley height $R_t$.

BRIEF DESCRIPTION OF THE DRAWINGS

Along with the claims, further aspects and advantages of the invention are also produced from the following description of preferred exemplary embodiments of the invention which are explained below by way of the figures, in which:

DETAILED DESCRIPTION

FIGS. 1*a* to 1*d* show various perspectives of a perforated plate component 10 to be used with dispensers according to the invention. Said perforated plate component 10, in the case of the embodiments shown below in the realization according to FIGS. 1*a* to 1*d* or the similar realizations according to FIGS. 2*a* and 2*b*, provide an application which is fastened in the dispensing head of a dispenser. In principle, developments where the perforated plate component is realized integrally with an outside housing of the dispensing head are conceivable.

Figure 1A:
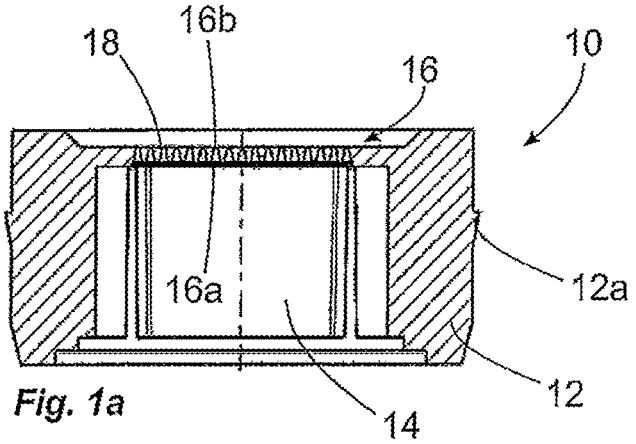
FIGS. 1*a*-1*d* show various perspective views of a perforated plate component for a dispenser according to the invention.
Figure 1B:
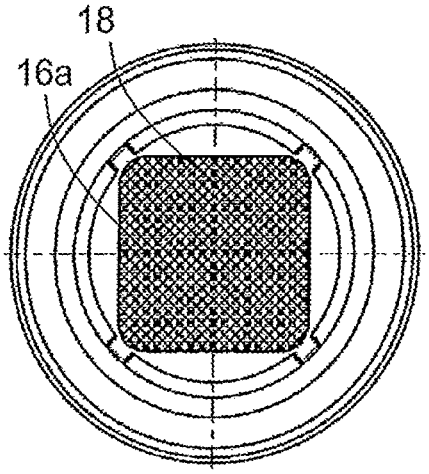
Figure 1C:
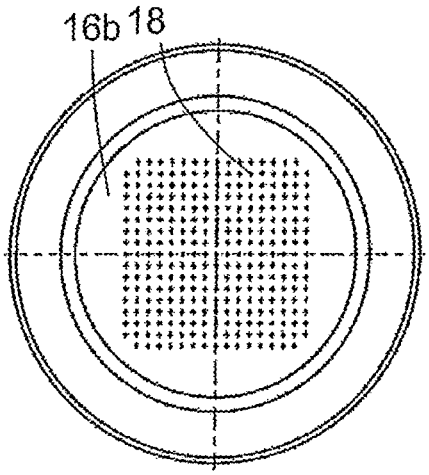
Figure 1D:
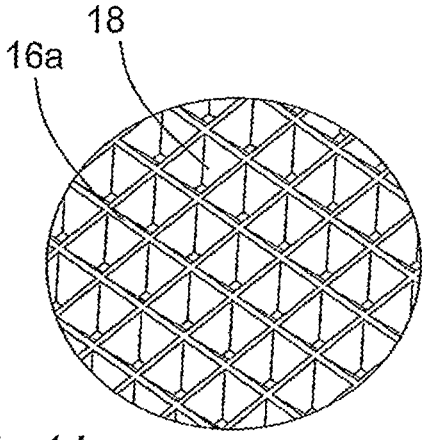
Figure 2A:
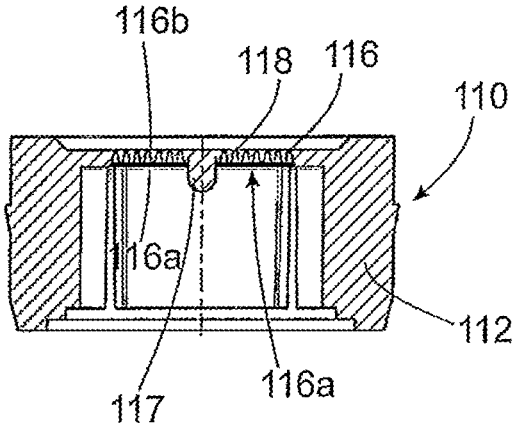
FIGS. 2*a* and 2*b* show a variant of the perforated plate component of FIGS. 1*a* to 1*d*, FIGS. 3*a* and 3*b* show a first variant of a dispenser according to the invention with the perforated plate component of FIGS. 2*a* and 2*b*.
Figure 2B:
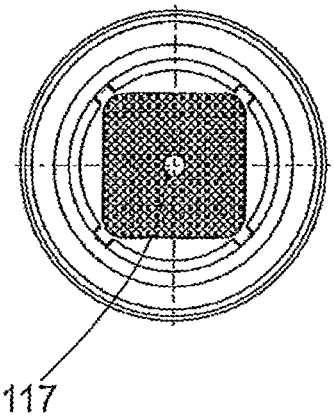

With reference to FIG. 1*a*, a perforated plate component 10 of this type has a circumferential edge region 12 with latching means 12*a* which are provided for latching in a latching groove of a dispensing head housing 12*b*. The circumferential edge region 12 bears a plate-like dispensing opening region 16 which spans over an inner region 14 of the perforated plate component and is penetrated by a plurality of dispensing openings 18. In total, the perforated plate component 10 of FIGS. 1*a* to 1*d* has more than 300 dispensing openings 18 which are arranged in the manner of a matrix. The thickness of the plate-like dispensing opening region which is penetrated by the dispensing openings in the present case is approximately 0.3 mm. The matrix-like arrangement of the dispensing openings 18 can be seen well in FIGS. 1*b* and 1*c* which show the perforated plate component 10 from an inside surface and an outside surface. With reference to FIG. 1*d* which shows the dispensing openings 18 from the inside surface, it can be seen that the dispensing openings are in each case in the form of a negative truncated pyramid and consequently taper from an inside surface 16*a* to an outside surface 16*b* of the dispensing opening region 16.

As can also be seen by way of the further exemplary embodiments, it is provided at least in the case of some developments of dispensers according to the invention that the dispensing opening region 16 is curved in the mounted state of the dispenser. Consequently, in the mounted state there is deformation of the dispensing opening region which consists of plastics material and is curved outwards as a result proceeding from the non-mounted state of FIG. 1*a*.

The second variant 110 of the perforated plate component which is shown in FIGS. 2*a* and 2*b* has a modification in relation to the embodiment of FIGS. 1*a* to 1*d* which is provided with regard to such a curvature. Thus, on the dispensing opening region 116 a pin or projection 117 which points towards the inside surface 116*a* is integrally formed on the dispensing opening region 116.

Figure 3A:
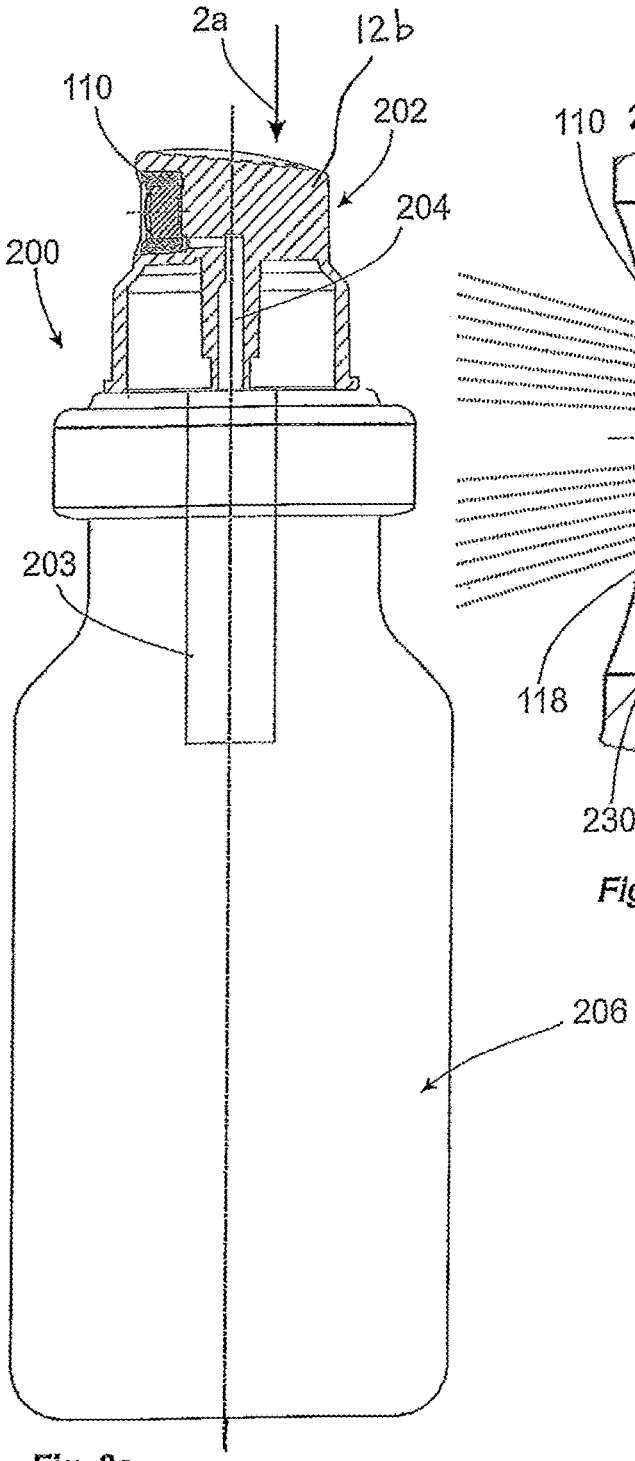

FIG. 3*a* shows a dispenser 200 according to the invention utilizing the perforated plate component 110 of FIGS. 2*a* and 2*b*.

The dispenser 200 shown has a dispensing head 202 which is connected in a manner not shown in any detail to a pump device 203 or a supply valve 203 in such a manner that in reaction to the dispensing head 202 being depressed in the direction 2*a*, liquid is supplied out of the liquid storage unit through the connecting channel 204 to the perforated plate component 110.

A pre-chamber 220, in which an inside body 230 is arranged or which is defined by said inside body 230, is connected upstream of the perforated plate component 110. Said inside body 230 fills out the pre-chamber 220 extensively. Over and above this, it has an end face 232 which points to the dispensing opening region 116 and has a curvature. The pin 117 of the perforated plate component 110 is supported on said end face 232 such that the dispensing opening region 116 is deformed and a gap of an approximately constant width is produced between the inside surface 116*a* of the dispensing opening region 116 and the end face 232 in the region of the dispensing opening region 116. The width of said gap in the present case is approximately 0.2 mm.

The dispensing opening region 116 is accordingly curved by the inside component 230 such that a diverging alignment of the dispensing openings 118 is produced. This leads to a spray jet as is indicated in the enlarged representation of FIG. 3*b*. Said spray jet consists of a plurality of individual jets.

As a result of its composition from individual jets, such a spray jet is suitable for the targeted planar dispensing of liquid, for example on the skin of a user. The spray jet is perceived to be very soft and pleasant as a result of the individual jets.

Figure 4:
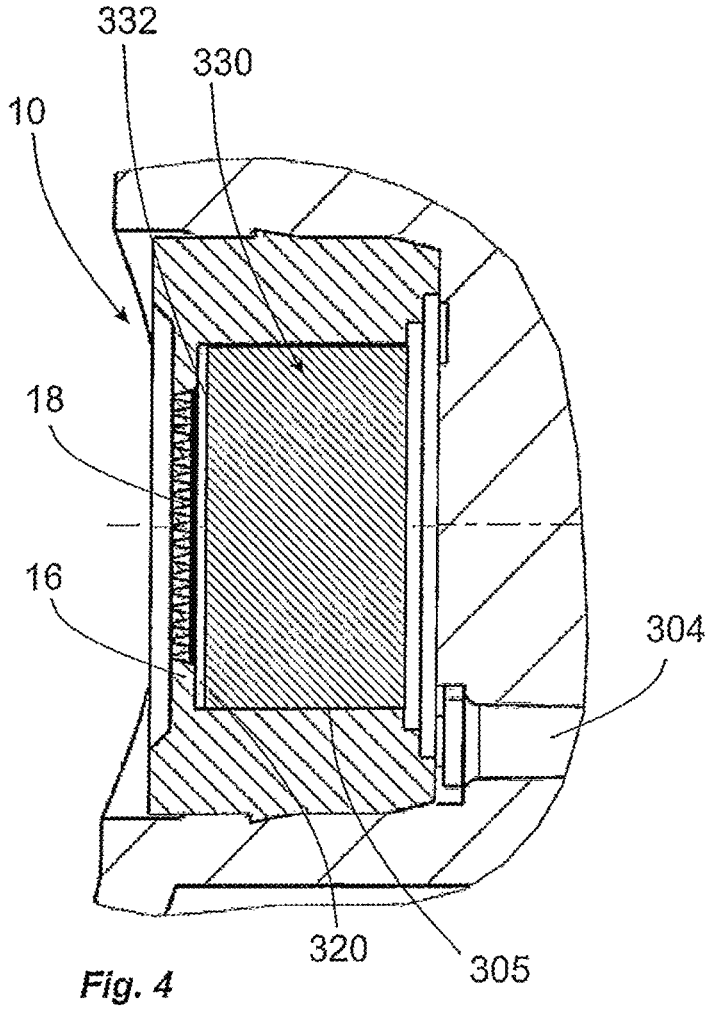
FIG. 4 shows a detail of the dispensing head of a dispenser realized as an alternative to the development in FIG. 3, FIGS. 5*a* to 5*c* show a further development of a dispenser according to the invention.

The development of FIG. 4 shows a very simple use of the perforated plate component 10 of FIGS. 1*a* to 1*d* in a dispenser which on the other side of the region shown in FIG. can have the identical design as that of FIG. 3*a*. The perforated plate component 10 is not deformed in the case of said development. However, there is provided an inside component 330 which, in a manner not shown in any more detail, enables in an edge region 305 an inflow of liquid out of the connecting channel 304 as far as up to the dispensing opening region 16. Additional grooves can be provided for this purpose in the edge region. The end face 332 of the inside component 330 is positioned very close to the inside surface 16*a* of the dispensing opening region 16. An inside gap between the inside surface 16*a* and the end face 332 is only 0.1 mm.

It has been shown that such a very narrow gap is advantageous, in particular as it allows the flow resistance of the liquid up to the dispensing openings 18 to be influenced purely as a result of the choice of a certain surface roughness on the end face 332. Consequently, different dispensing characteristics can be achieved purely as a result of the surface roughness on the end face 332 and with one constant perforated plate component 10.

Figure 3B:
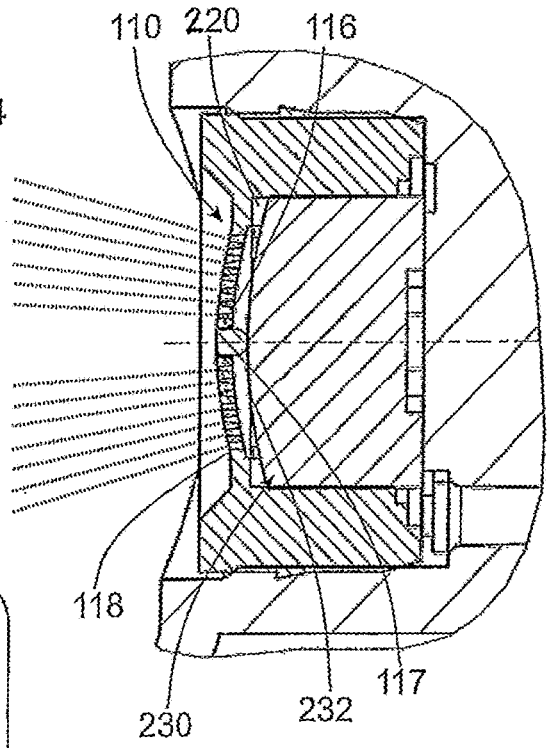
Figure 5A:
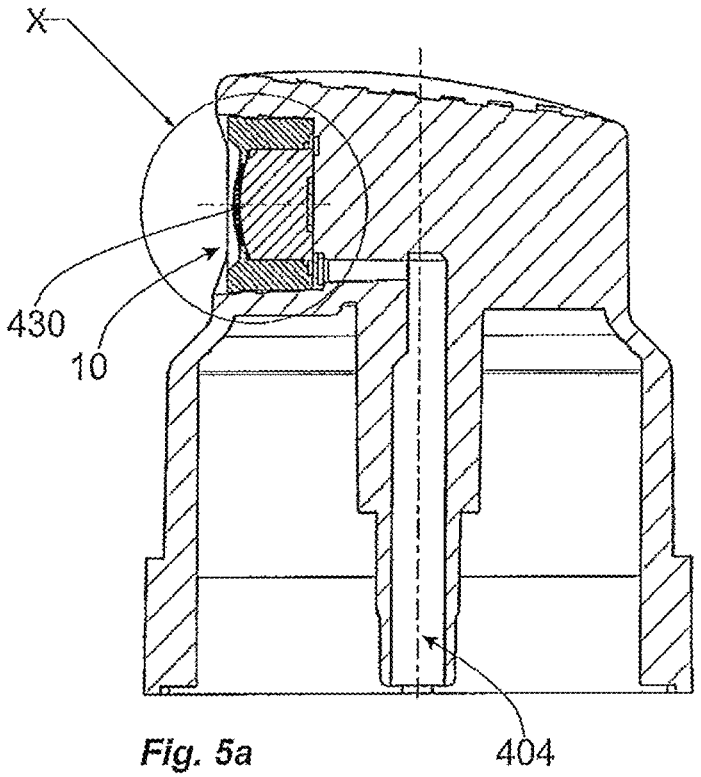
Figure 5B:
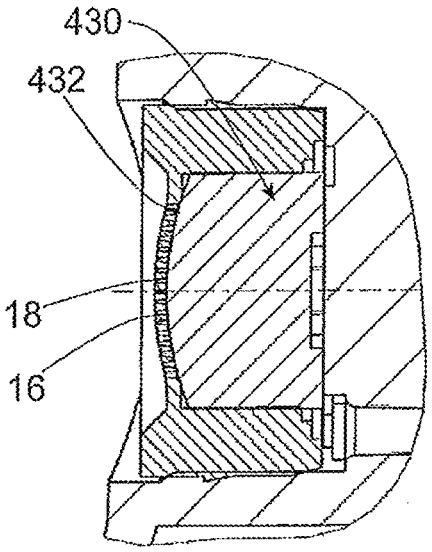
Figure 5C:
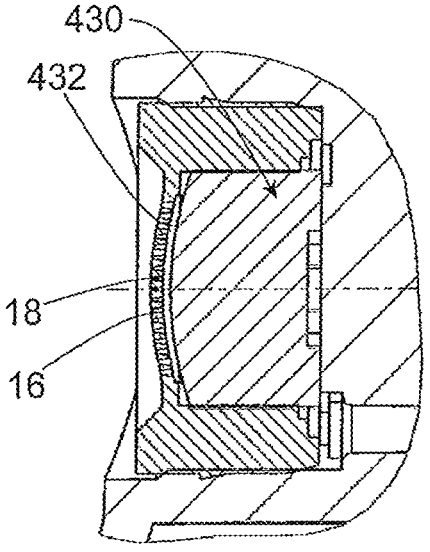

In the case of the development according to FIGS. 5*a* to 5*c*, the perforated plate component of FIGS. 1*a* to 1*d* is used once again. Said perforated plate component interacts with an inside component 430 which has a similar development to that inside component 230 of FIG. 3*a*. The inside component 430 also has a curved end face 432 which points in the direction of the dispensing opening region 16 of the perforated plate component 10. In the non-active state of the dispenser there is interaction, as shown on the bottom left-hand side in FIG. 5*b*. The inside surface 16*a* of the dispensing opening region 16 abuts flatly against the end face 432 and consequently in said non-active state closes the dispensing openings 18, in particular also against the ingress of contaminants. If the pre-chamber 420 is then supplied with pressurized liquid through the supply channel 404, a liquid pressure builds here which, as a result of the very narrow dispensing openings, is suitable to raise the dispensing opening region 16 in its totality from the end face 432. The previously closed dispensing openings 18 are opened as a result of this and a diverging spray jet which is comparable with that of FIG. 3*b* is formed. As soon as the liquid pressure falls away, the dispensing opening region 16 returns into the position in FIG. 3*a* and consequently closes the dispensing openings 18 again.

Figure 6A:
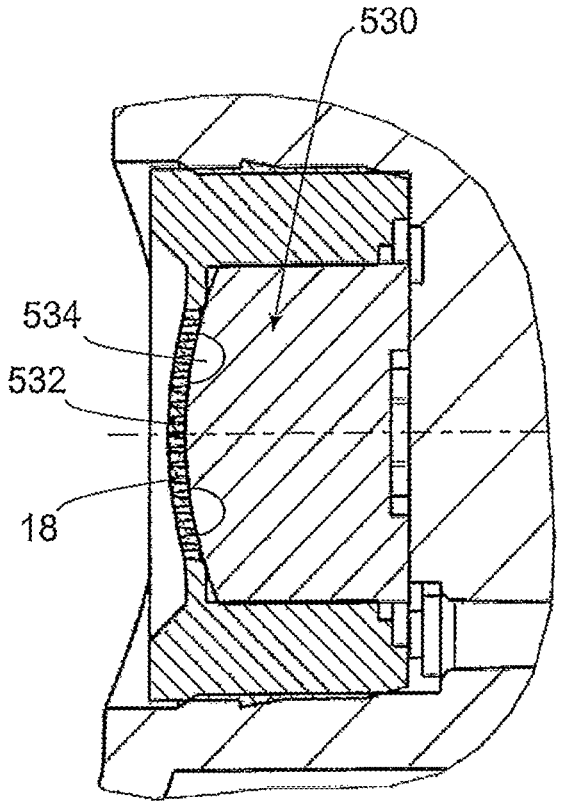
FIG. 6*a* shows a further development of a dispenser according to the invention.

FIG. 6*a* shows a variant of the dispenser or of the dispensing head thereof where such deformation of the dispensing opening region 16 is not provided. Instead of which set-back free regions 534 are provided in the inside component 530 on the end face 532 thereof, through which free regions the liquid is able to pass selectively to some of the dispensing openings 18, whilst others are permanently blocked by the end face 532. As a result, a spray pattern, which does not require different perforated plate components 10 but is able to be realized purely by different inside components, can be adjusted from case to case.

Figure 6B:
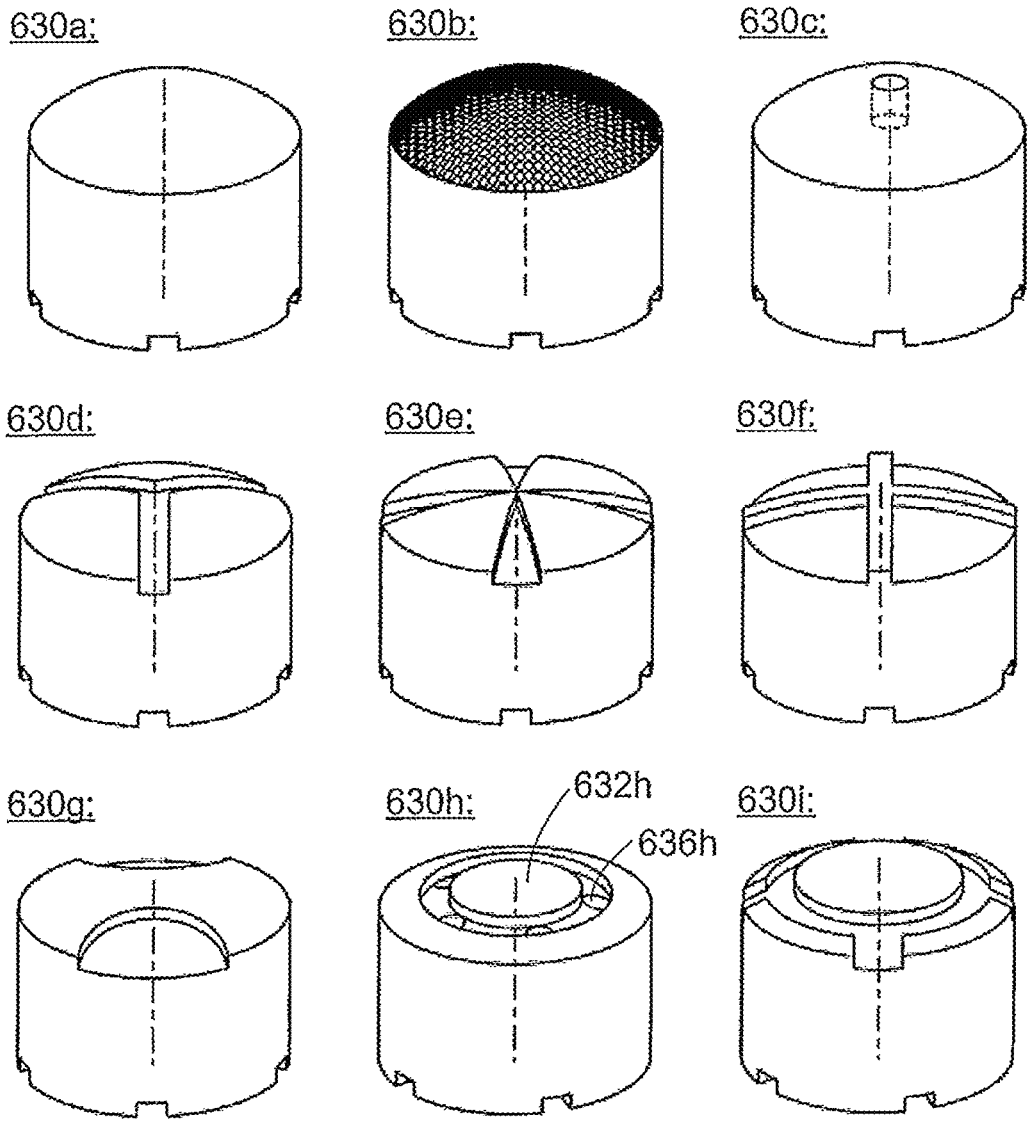
FIGS. 6*b* and 6*c* show different inside components for use with a dispenser according to the invention and by way of the example of the interaction of one of them with the perforated plate component.

FIG. 6*b* shows a plurality of possible inside components.

The inside component 630*a* corresponds with the inside component which is used in the case of the developments of FIGS. 3*a*, 3*b*, 5*a*, 5*b* and 5*c*. The other inside components 630*b* to 603*i* lead to particular spray patterns as, in each case, they cover some of the dispensing openings 18 or, however, the inflow of liquid is influenced in another manner.

Figure 6C:
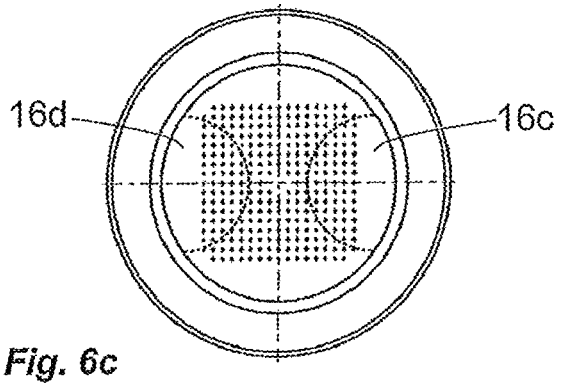

Thus, for example, only two left-hand and right-hand part regions of the dispensing opening region of the perforated plate component 10 are not closed by the inside component 630*g*. By way of FIG. 6*c* it can be seen that the predominant part of the dispensing openings 18 can serve not for dispensing liquid. The liquid only exits in the two part regions 16*c*, 16*d* of the dispensing opening region 16 and consequently brings about a diverging spray pattern divided into two.

A particular mention is also advisable with regard to the inside component 630*h*. In this case, the inside component 630*h* is provided with penetrating channels 636*h* which supply the indentations on one end face 632*h* and consequently the dispensing openings of the perforated plate component with liquid to be dispensed. Consequently, no care has to be taken to ensure that the liquid is able to pass laterally past the inside component as far as up to the dispensing opening region 16.

The representation of the inside component 630*b* acts to explain a particular surface roughness in the region of the end face. The surface on said end face of the component has an average peak-to-valley height $R_t$ of between 10 μm and 100 μm, preferably of between 20 μm and 50 μm. When such an inside component 630*b* is used with the dispensing head of FIG. 6*a*, the liquid, which has flowed laterally past the inside component 630*b*, is able to pass to the dispensing openings 18 without requiring displacement or deformation of the dispensing opening region 16 or of the inside component as a result of the named peak-to-valley height on the end face. By varying the peak-to-valley height, in this case, it is possible to influence the size of the corresponding volume flow.

Figure 7A:
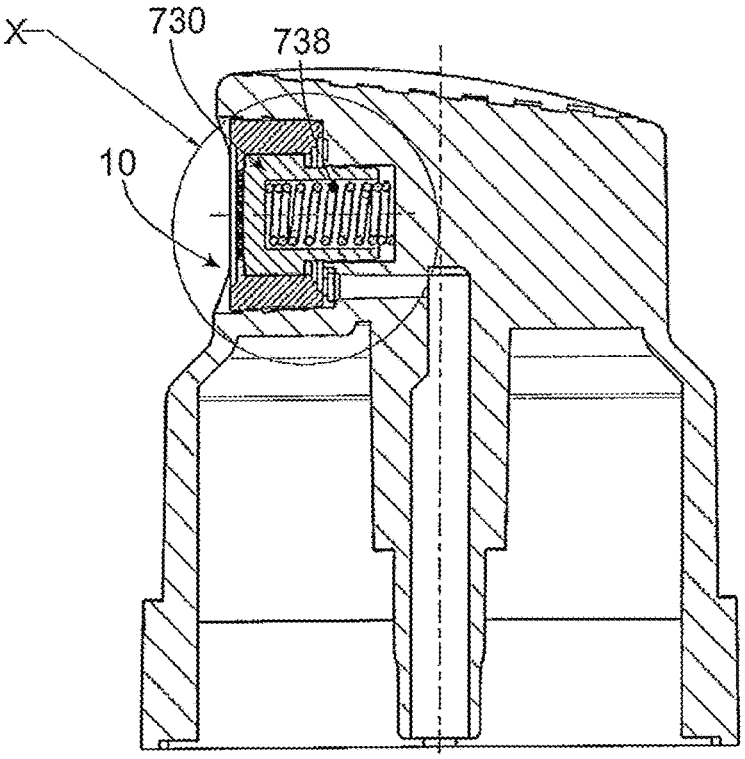
FIGS. 7*a* to 7*c* show a further development of a dispenser according to the invention and FIGS. 8*a* to 8*b* show a further development of a dispenser according to the invention.
Figure 7B:
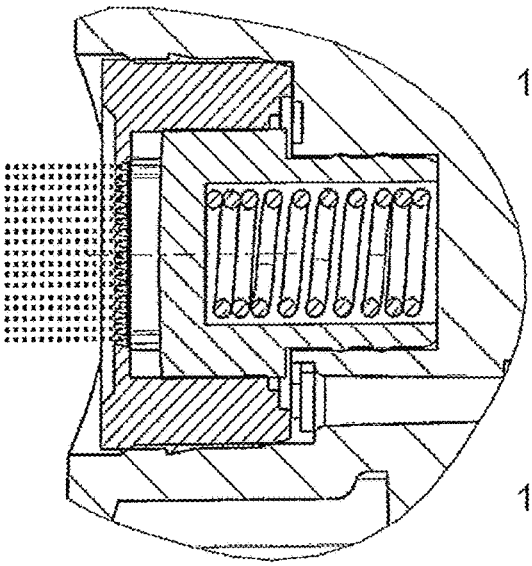
Figure 7C:
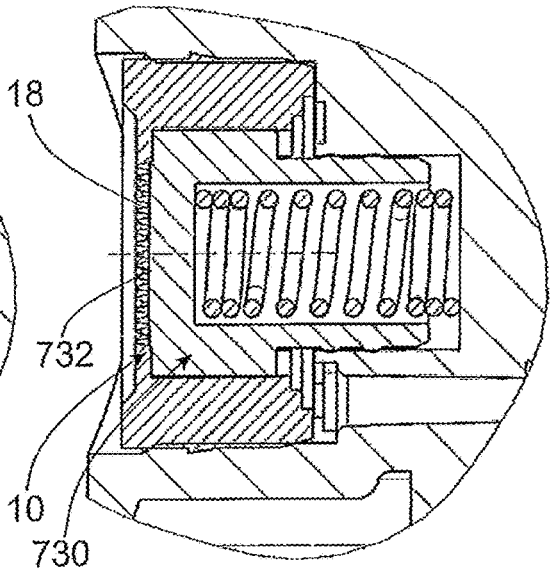

The development of FIGS. 7*a* to 7*c* is comparable with the development of FIGS. 5*a* to 5*c* with regard to its intended action. Here too a valve, which is able to close the dispensing openings 18 of the perforated plate unit 10, is provided. However, said valve includes an inside body 730 which is displaceable in contrast in its totality and is acted upon with force in the direction of the closed position by means of a spring 738 which is supported on the housing of the dispensing head. This can be seen in particular in FIG. 7*c*.

The result of said application of force is that in the case of a lack of liquid supply, an end face 732 of the inside body 730, which acts as the valve body, abuts against an inside surface 16*a* of the dispensing opening region 16 of the perforated plate component 10 and consequently closes the dispensing opening region 18. As soon as the liquid flows in, it passes into a narrow gap between the end face 732 and the perforated plate component 10 and then presses the valve body 730 against the force of the valve spring 738 into its open position, which is shown in FIG. 7*b*. It is possible to dispense liquid in said open position. Once the dispensing has been terminated and the liquid pressure has fallen away, the valve assumes its closed position again of FIG. 7*a*.

Figure 8A:
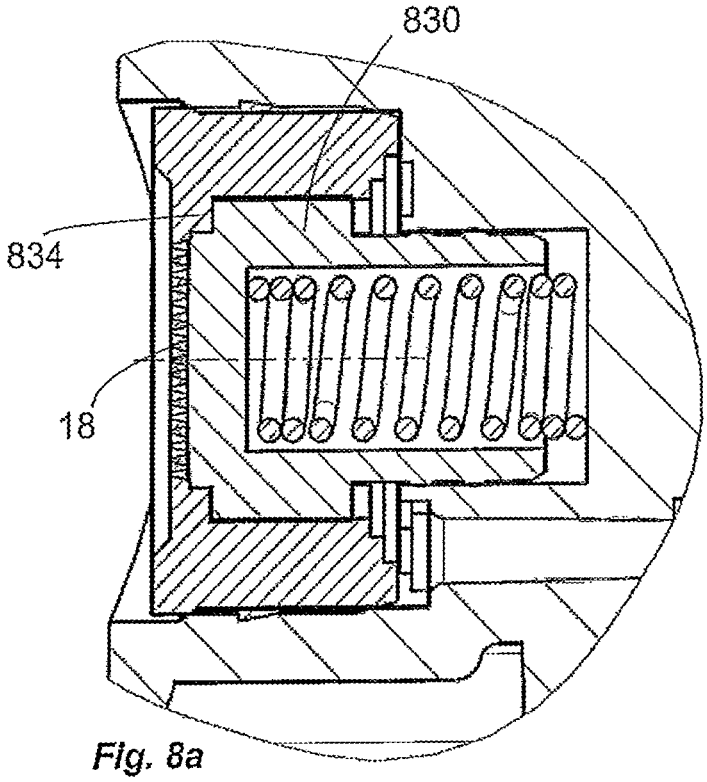
Figure 8B:
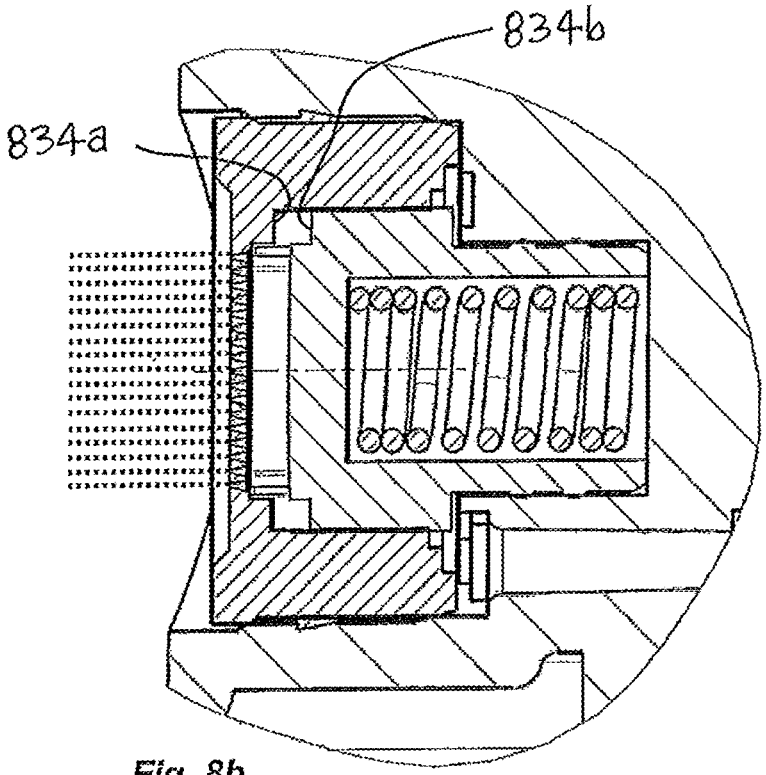

The development of FIGS. 8*a* and 8*b* shows an alternative development where the perforated plate component and the valve body 830 are adapted to one another and have a gradation as a result of which a circumferential valve pressure chamber 834 is formed. The pressure chamber 834 is defined, at least partially, by and between opposed valve surfaces 834*a* and 834*b* of the plate 10 and the valve body 830, these opposed valve surfaces 834*a* and 834*b* being provided on peripheral steps on the valve body and the valve seat. The incoming liquid is initially collected during dispensing in said valve pressure chamber 834, but is not yet able to pass to the dispensing openings 18. Not until the valve body 830 has been displaced sufficiently rearwards as a result of the liquid pressure of the liquid in the valve pressure chamber 834 does the liquid pass into an intermediate region between the valve body and the dispensing opening region of the perforated plate component 10 and is dispensed from there. As a result of said design with the circumferential gradation, it is accordingly achieved that the unobstructed inflow to all the dispensing openings 18 is created at the same time.

The invention claimed is:

1. A dispenser for dispensing liquids, said dispenser comprising:

a liquid storage unit;

a dispensing head with a perforated plate component having multiple dispensing openings disposed in a dispensing opening region and arranged in a density of at least 5 dispensing openings/mm$^2$;

a pre-chamber connected upstream of said dispensing openings of said perforated plate component and from which said dispensing openings are supplied;

a connecting channel connecting said liquid storage unit to said pre-chamber; and an outlet valve including a valve seat fixed in position with respect to an outside housing of said dispensing head and a valve body movable in relation to said valve seat and controlling an inflow of liquid to said dispensing openings together with said valve seat, one of said valve seat and said valve body being formed by said perforated plate component, said outlet valve having a closed position wherein said valve seat and said valve body abut one another and prevent liquid from exiting said dispensing head;

the valve seat and the valve body forming a circumferential valve pressure chamber for collecting liquid coming from the connecting channel and preventing the liquid from passing to the dispensing openings until the valve body has been displaced more than a set spaced distance from the valve seat, wherein once the valve body has moved more than the set spaced distance from the valve seat, the liquid is allowed to simultaneously flow to all the dispensing openings.

2. The dispenser of claim 1, wherein said outlet valve moves into the closed position without causing substantial deformation of said valve seat and said valve body.

3. The dispenser of claim 1, wherein said outlet valve includes a biasing member disposed to bias said outlet valve in the closed position and prevent fluid flow through said dispensing openings.

4. The dispenser of claim 1, wherein said dispensing opening region in an area thereof facing the other of said valve seat and said valve body is substantially planar and the other of said valve seat and said valve body has a substantially planar end face disposed to abut said substantially planar area of said dispensing opening region in the closed position of said outlet valve.

5. The dispenser of claim 4, wherein said outlet valve includes a biasing member disposed to bias said outlet valve in the closed position and prevent fluid flow through said dispensing openings.

6. The dispenser of claim 1, wherein said valve seat is formed by said perforated plate component and said outlet valve has an open position in which pressurized liquid is supplied from said connecting channel to said circumferential valve pressure chamber and causes displacement of said valve body into the open position wherein said valve body is spaced from said perforated plate component.

7. The dispenser of claim 6, wherein said outlet valve includes a biasing member disposed to bias said valve body in the closed position of said outlet valve, and the pressurized liquid in said circumferential valve pressure chamber causes displacement of said valve body into the open position against a biasing force of said biasing member to allow fluid flow through said dispensing openings.

8. The dispenser of claim 1, wherein said outlet valve has an open position and includes a valve surface disposed in surrounding relation with all of said dispensing openings, said valve body and said valve seat abutting against one another in a region of said valve surface in the closed position of said outlet valve and being out of contact with one another in the region of said valve surface in the open position of said outlet valve.

9. The dispenser of claim 8, wherein said valve surface defines part of said pre-chamber.

10. The dispenser of claim 8, wherein said outlet valve includes a biasing member disposed to bias said outlet valve in the closed position to prevent fluid flow through said dispensing openings, and pressurized liquid in said circumferential valve pressure chamber causes displacement of said valve body into the open position against a biasing force of said biasing member to allow the fluid flow through said dispensing openings.

11. The dispenser of claim 10, wherein said valve seat is formed by said perforated plate component and the pressurized liquid is supplied from said connecting channel to said circumferential valve pressure chamber to cause displacement of said valve body into the open position wherein said valve body is spaced from said perforated plate component.

12. The dispenser of claim 1, wherein said valve seat and said valve body define respective valve surfaces disposed in opposed relation with one another and in surrounding relation with all of said dispensing openings, said pre-chamber being defined between said valve surfaces.

13. The dispenser of claim 12, wherein said outlet valve includes a biasing member disposed to bias said outlet valve in the closed position to prevent fluid flow through said dispensing openings, and pressurized liquid in said circumferential valve pressure chamber causes displacement of said valve body into an open position against a biasing force of said biasing member to allow the fluid flow through said dispensing openings.

14. The dispenser of claim 1, wherein the circumferential valve pressure chamber is formed between a first peripheral step on the valve seat and a second peripheral step on the valve body.

15. The dispenser of claim 14, wherein the first peripheral step and the second peripheral step are complimentary with a first one of the first peripheral step and the second peripheral step being received within a second one of the first peripheral step and the second peripheral step when the circumferential valve pressure chamber is closed and when the valve seat abuts the valve body.

16. The dispenser of claim 14, wherein the first peripheral step and the second peripheral step are complimentary with the first peripheral step being received within the second peripheral step when the circumferential valve pressure chamber is closed and when the valve seat abuts the valve body.

17. A dispenser for dispensing liquids, said dispenser comprising:

a liquid storage unit;

a dispensing head with a perforated plate component having multiple dispensing openings disposed in a dispensing opening region and arranged in a density of at least 5 dispensing openings/$mm^2$;

a pre-chamber connected upstream of said dispensing openings of said perforated plate component and from which said dispensing openings are supplied;

a connecting channel connecting said liquid storage unit to said pre-chamber; and an outlet valve including a valve seat fixed in position with respect to an outside housing of said dispensing head and a valve body movable in relation to said valve seat and controlling an inflow of liquid to said dispensing openings together with said valve seat, one of said valve seat and said valve body being formed by said perforated plate component, said outlet valve having a closed position wherein said valve seat and said valve body abut one another and prevent liquid from exiting said dispensing head;

wherein the liquid is prevented from passing to the dispensing openings until the valve body has been displaced more than a set spaced distance from the valve seat, wherein once the valve body has moved more than the set spaced distance from the valve seat, the liquid is allowed to simultaneously flow to all the dispensing openings.

18. The dispenser of claim 17, wherein said outlet valve moves into the closed position without causing substantial deformation of said valve seat and said valve body.

19. The dispenser of claim 17, wherein said outlet valve includes a biasing member disposed to bias said outlet valve in the closed position and prevent fluid flow through said dispensing openings.

20. The dispenser of claim 17, wherein said dispensing opening region in an area thereof facing the other of said valve seat and said valve body is substantially planar and the other of said valve seat and said valve body has a substantially planar end face disposed to abut said substantially planar area of said dispensing opening region in the closed position of said outlet valve.

21. The dispenser of claim 20, wherein said outlet valve includes a biasing member disposed to bias said outlet valve in the closed position and prevent fluid flow through said dispensing openings.

* * * * *